United States Patent [19]

Cohen

[11] Patent Number: 4,793,394

[45] Date of Patent: Dec. 27, 1988

[54] BALL CAN CARRIER ATTACHMENT FOR TENNIS RACKET COVERS

[76] Inventor: Jack M. Cohen, 20471 Nashville St., Chatsworth, Calif. 91311

[21] Appl. No.: 151,218

[22] Filed: Feb. 1, 1988

[51] Int. Cl.[4] ..... A63B 49/18; A63B 61/00

[52] U.S. Cl. ..... 150/52 G; 24/17 B; 206/315.1; 206/315.9; 224/250; 224/901; 224/919; 248/311.2; 248/313; 248/499; 273/74; 273/73 R

[58] Field of Search ..... 150/52 R, 52 A, 52 G; 206/315.1, 315.9, 478, 805; 273/29 R, 73 R, 74; D3/30.1, 36, 99, 104; 224/919, 901, 250; 24/17 R, 17 A, 17 B; 190/102; 248/205.2, 205.3, 311.2, 505, 313, 499

[56] References Cited

U.S. PATENT DOCUMENTS

| | | | |
|---|---|---|---|
| D. 238,628 | 2/1976 | Davis | D3/104 |
| D. 245,813 | 9/1977 | Davis | D3/36 |
| 1,842,072 | 1/1932 | Collingbourne | 206/805 X |
| 2,088,980 | 8/1937 | Stein | 273/74 X |
| 2,429,342 | 10/1947 | Brown et al. | 273/74 X |
| 2,738,976 | 3/1956 | Vallieres | 206/315.9 X |
| 2,851,762 | 12/1974 | Liblick | 206/805 X |
| 2,932,514 | 4/1960 | Bergmark | 224/919 X |
| 3,403,427 | 10/1968 | Asseo et al. | 24/17 B X |
| 3,891,174 | 6/1975 | Harvey | 150/52 G X |
| 3,993,307 | 11/1976 | Errico | 273/73 R |
| 4,072,256 | 2/1978 | Young | 206/315.9 X |
| 4,413,762 | 11/1983 | Carini | 224/919 X |

*Primary Examiner*—Sue A. Weaver
*Attorney, Agent, or Firm*—Natan Epstein

[57] ABSTRACT

A web attachment for holding a tubular ball container to a tennis racket cover consists of four segments of pliable ribbon joined at their ends to form a rectangular frame, a fifth segment of pliable ribbon secured at one of its ends to the midpoint of one of the four segments and lying exteriorly to the frame and terminating in a free end, and adhesive material on two of the four sides and on the free end for attachment of the web to the racket cover.

6 Claims, 1 Drawing Sheet

BALL CAN CARRIER ATTACHMENT FOR TENNIS RACKET COVERS

BACKGROUND OF THE INVENTION

Field of the Invention

The present invention relates generally to the field of sporting equipment and accessories therefor, and more particularly relates to an attachment for a tennis racket cover for holding one or more tubular ball containers to a racket cover.

BACKGROUND THE INVENTION

Fenced tennis courts normally have hinged access gates in the fence with gate latches which must be manually operated by the players entering or leaving the courts. Tennis players carrying their gear to a match are thus frequently confronted with the problem of opening and closing the court gates while having both hands occupied with an assortment of gear which at a minimum includes a tennis racket, one or more cans of tennis balls, and frequently a container of liquid refreshment and/or a towel; in some cases the gear may be still more elaborate and include a variety of other unattached articles useful on the courts. Thus burdened, the player finds it difficult to work the gate latches, and awkward maneuvers are necessary in order to gain access or egress through the fence gate.

Many players keep a tennis racket and one or more cans of tennis balls in the trunk of their automobiles, where it is desirable to keep the can of balls together with the racket to keep it from becoming lost among the usual assortment of odds and ends found in automobile trunks.

What is needed therefore is an easy to install attachment or accessory for a tennis cover, of simple and inexpensive construction, useful for retaining at least one tennis ball container to the cover in an easily accessible manner, so that the balls can be conveniently carried in one hand with the racket.

SUMMARY OF THE INVENTION

This invention seeks to meet the aforementioned needs by providing a web attachment for holding a tubular ball container to a cover for a stringed racket of the type having at least one planar outer cover surface. The web attachment is preferably manufactured of low cost flat ribbon such as the elastic ribbon commonly used in the garment industry for making elastic waist bands and the like. More specifically, the web is assembled of four lengths of pliable ribbon joined at their ends, as by stitching, to define a rectangular frame. A fifth ribbon segment is attached at one of its ends to the midpoint of one of the frame sides transversely thereto, extending outwardly of the frame and terminating in a free end. The web is attached and secured to a tennis racket cover by an adhesive coating provided on the two long sides of the web frame and at the free end of the fifth ribbon segment. It is presently preferred that the adhesive be a contact adhesive normally covered by a release sheet which is removed for exposing the adhesive just prior to application to the racket cover. It is within the scope of this invention however, to make use of loop-and-hoop strips in lieu of a contact adhesive coating for securing the web to the racket cover.

Figures 1, 2, 3, 4, 5, 6, 6A, 7:
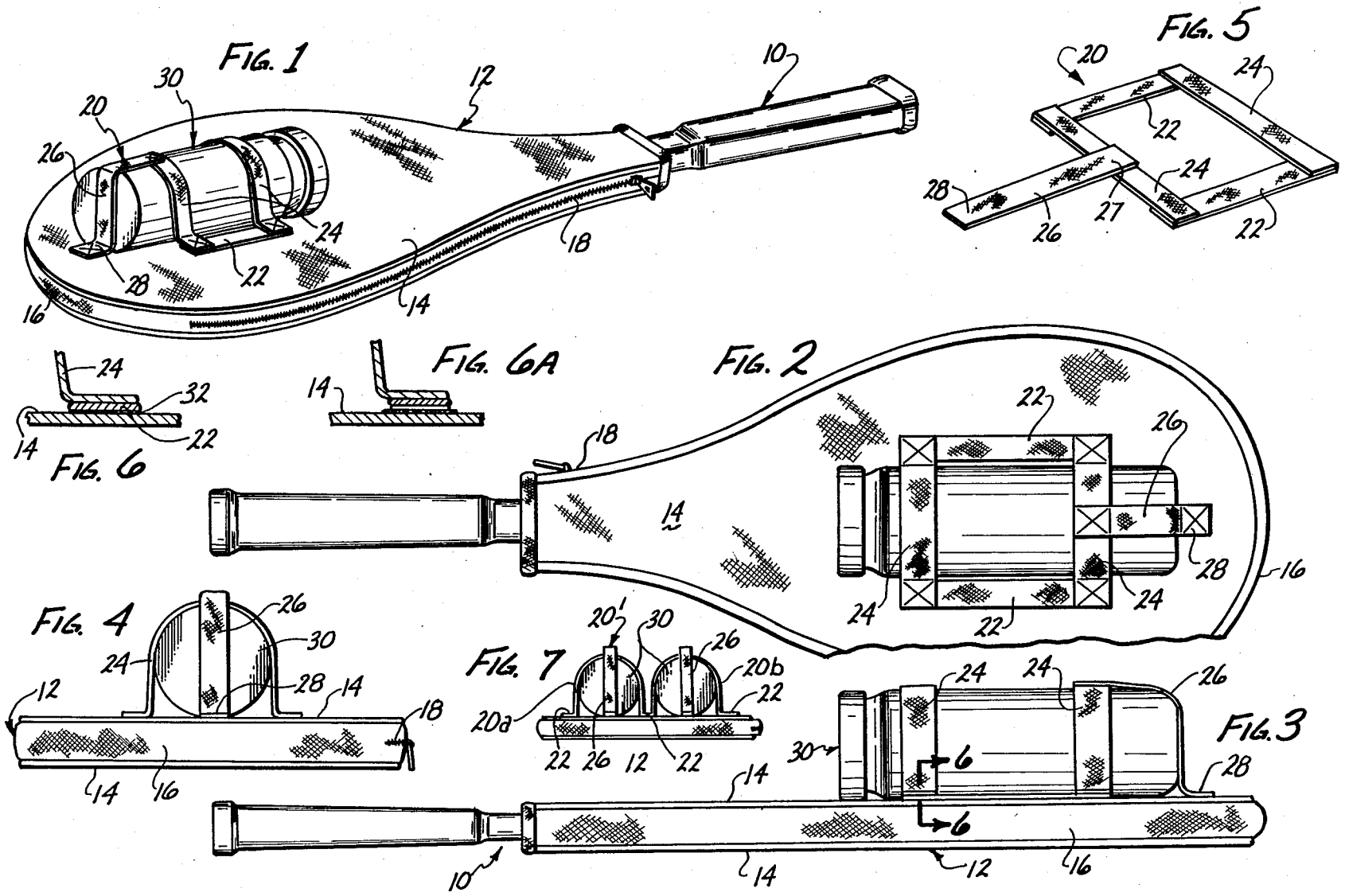
FIG. 1 is a perspective view of the novel web attachment of this invention shown fixed to a racket cover and holding a can of tennis balls to the cover.
FIG. 2 is a top plan view of the racket and web attachment in FIG. 1.
FIG. 3 is a side elevational view of the racket and web attachment of FIGS. 1 and 2.
FIG. 4 is an end view seen from the right hand side of FIGS. 2 and 3.
FIG. 5 is a perspective illustration of the web attachment laid flat prior to attachment to the racket cover.
FIG. 6 is a detail sectional veiw taken along lines 6—6 in FIG. 3 showing the adhesive attachment of the web to the racket cover.

FIG. **6*a* is a view as in FIG. 6** but showing use of hoop-and-loop strips for securing the web to the racket cover in lieu of an adhesive coating;

FIG. 7 is an end view as in FIG. 4 but showing a twin version of the web attachment for holding two cylindrical tennis ball containers to the racket cover.

DETAILED DESCRIPTION OF THE PREFERRED EMBODIMENTS

With reference to the drawings, FIG. 1 shows a typical tennis racket with its head sheathed in a protective envelope style cover 12. The cover 12 includes two opposite faces 14 permanently joined along most of their common edge 16 and provided with a zippered opening 18 extending along part of the common edge to allow insertion and extraction of the racket 10.

Turning to FIG. 5, the web attachment 20 is seen to include two ribbon segments pairs, longitudinal ribbons 22 and transverse ribbons 24 respectively. The ribbon segments in each pair are mutually parallel and the two pairs are perpendicular to each other with the ribbons overlapping and sewn together at their ends to the define a rectangular frame. The end 27 of a fifth, bottom ribbon segment 26 is fixed to the mid-point of one segment 24. The segment 26 is perpendicular to the segment 24 and lies outside the frame ending in a free end 28. The longitudinal strips 22 and the free end 28 of the bottom segment 26 are coated on one similarly facing side with a layer of contact adhesive 32, which in turn is covered with a protective release sheet removable just prior to mounting of the web attachment 20 to a racket cover 12.

The web 20 may be installed on the racket cover 12 preferably by using a commercially available tubular ball container 30 as a layout aid. Tennis ball containers are conventionally cylindrical tubes standard sized for holding three tennis balls. The installation procedure may be as follows. The transverse strips 24 of the web are wrapped about the circumferent of the cylindrical container 30 after positioning the container in the desired location and orientation on the racket cover surface 14. The protective release covering is removed from the longitudinal strips 22 to expose the contact adhesive 32 and the strips 22 are then pressed against the cover surface 14 and fixed in place on either side of the ball container 30 as shown in FIGS. 2 and 6. The container can then be slid longitudinally within the loops defined by the transverse strips 24 until the bottom strip 26 can be folded over the bottom end of the container 30 as best understood from FIG. 3, with the adhesive covered end 28 of the strip 26 laid flat against the cover face 14 to bring the adhesive coated end portion 28 (after removal of the corresponding protective release sheet) into contact with the racket cover face 14 as in FIGS. 3 and 4. The installation of the web 20 is quick and simple on virtually any existing racket cover of the general type shown and described. The web attachment 20 does not add noticeably to the original weight of the racket cover and it flattens easily in the absence of a ball container 30 for storage purposes. The open web permits inspection at a glance of the contents of the many commercially available tennis ball containers made of transparent plastic.

If desired, the adhesive means of the web 20 may consist, in lieu of the adhesive coating 32, of strips of hook-and-loop tape attached respectively to the longitudinal strips 22 and the racket cover face 14 in mutually facing relationship, with a similar arrangement provided for securing the tape end 28. Such hook-and-loop fastener tape commonly known as Velcro (Reg. TM), would permit the web 20 to be removed from the racket cover when not in use. It is contemplated, however, that the adhesive coated version of FIG. 6 would in most cases be preferable given the minimal weight and bulk of the web 20.

FIG. 7 shows an end view of an alternate, twin or double version of the web 20′ consisting essentially of two single webs 20 sharing a common longitudinal strip 22, which when applied to the racket cover face 14 is capable of receiving two tubular ball containers 30 held independently of one another, side by side on the racket cover face 14.

The ribbon used for the segments 22, 24 and 26 may be an elastic ribbon so as to provide a positive friction grip on the container 30 by making the loops 24 somewhat undersized so that the ribbon is stretched upon insertion of the ball container, and also to allow some variation in the size of the container 30 to be held in the web 20 so that not only tennis ball cans may be held but also beverage containers of generally comparable size. A can of balls and a beverage container could be carried side by side in a double web 20′ such as in FIG. 7. It is within the scope of this invention, of course, to size differently the webs 20*a* and 20*b* of the double web 20′ so as to accommodate differently sized containers.

Particular embodiments of the present invention have been illustrated and described by way of example only and for purposes of clarity, but without limitation to the scope of protection afforded to this invention which is defined only by the following claims.

What is claimed is:

1. A web attachment for holding a tubular ball container to a cover for a stringed racket of the type having at least one planar outer cover surface, said attachment comprising:

a rectangular frame consisting of four segments of pliable ribbon joined at their ends;

a fifth segment of pliable ribbon secured at one of its ends to the midpoint of one of said four segments and lying exteriorly to said frame and terminating in a free end; and adhesive means provided on two of said four segments and said free end for attachment of the web to the cover surface.

2. The web of claim 1 wherein said pliable ribbon is also elastic ribbon.

3. The web of claim 1 wherein said adhesive means is a coating of contact adhesive normally covered by release sheet means removable for exposing said adhesive prior to attachment to the cover surface.

4. The web of claim 1 wherein said adhesive means comprise hook-and-loop strip means.

5. In a racket cover having two cover faces joined along common edges for receiving a stringed racket therebetween, the improvement comprising:

a web having a rectangular frame consisting of four segments of pliable ribbon joined at their ends, and a fifth segment of pliable ribbon exterior to said frame but connected transversely to one of said four segments and terminating in a free end;

adhesive means provided on two of said four segments and said free end for attachment of the web to the cover surface; and two of said four segments secured by said adhesive means to an outer surface of said racket cover in mutually parallel relationship spaced apart by substantially less than the length of each of the outer two of said four segments to form loops adapted to receive the circumference of a cylindrical ball container and hold the container to the racket cover;

said free end being adhesively secured to said surface for supporting one end of the ball container against axial displacement through said loops.

6. The improvement of claim 5 wherein said cover has a closed end and an opposite handle end, and said web is oriented on said racket cover with said fifth segment aligned between said ends and said adhesively secured end proximal to said closed end.

* * * * *